US010153621B2

(12) United States Patent
Sumoyama et al.

(10) Patent No.: US 10,153,621 B2
(45) Date of Patent: Dec. 11, 2018

(54) SPARK PLUG

(71) Applicant: NGK SPARK PLUG CO., LTD., Nagoya-shi, Aichi (JP)

(72) Inventors: Daisuke Sumoyama, Nagoya (JP); Takuto Nakada, Komaki (JP)

(73) Assignee: NGK SPARK PLUG CO., LTD., Nagoya-shi, Aichi (JP)

( * ) Notice: Subject to any disclaimer, the term of this patent is extended or adjusted under 35 U.S.C. 154(b) by 0 days.

(21) Appl. No.: 15/577,389

(22) PCT Filed: May 16, 2016

(86) PCT No.: PCT/JP2016/002396

§ 371 (c)(1),
(2) Date: Nov. 28, 2017

(87) PCT Pub. No.: WO2016/189826

PCT Pub. Date: Dec. 1, 2016

(65) Prior Publication Data

US 2018/0166863 A1 Jun. 14, 2018

(30) Foreign Application Priority Data

May 28, 2015 (JP) ..... 2015-108261

(51) Int. Cl.

| | |
|---|---|
| ***H01T 13/39*** | (2006.01) |
| ***H01T 13/20*** | (2006.01) |
| ***C22C 5/04*** | (2006.01) |
| ***H01T 13/32*** | (2006.01) |
| ***H01T 21/02*** | (2006.01) |

(52) U.S. Cl.

CPC ..... *H01T 13/39* (2013.01); *C22C 5/04* (2013.01); *H01T 13/20* (2013.01); *H01T 13/32* (2013.01); *H01T 21/02* (2013.01)

(58) Field of Classification Search

CPC ..... H01T 13/39; H01T 21/02; H01T 13/32; C22C 5/04

See application file for complete search history.

(56) References Cited

U.S. PATENT DOCUMENTS

| | | | | |
|---|---|---|---|---|
| 6,232,704 | B1 * | 5/2001 | Herweg | H01T 13/39 313/141 |
| 2005/0179353 | A1 * | 8/2005 | Watanabe | H01T 13/20 313/141 |
| 2016/0276811 | A1 * | 9/2016 | Kanemaru | H01T 13/39 |

FOREIGN PATENT DOCUMENTS

| | | |
|---|---|---|
| JP | A-2004-031300 | 1/2004 |
| JP | A-2004-127681 | 4/2004 |

OTHER PUBLICATIONS

International Search Report from corresponding International Patent Application No. PCT/JP16/02396, dated Jul. 5, 2016.

* cited by examiner

*Primary Examiner* — Kevin Quarterman
(74) *Attorney, Agent, or Firm* — Kusner & Jaffe

(57) ABSTRACT

A spark plug having a tip provided on at least one of a center electrode and a ground electrode. The tip includes a body portion, a coating layer, and a high specific resistance layer. The body portion contains mostly Ir. The high specific resistance layer is provided on a side peripheral surface of the body portion, has a Ni content greater than the Ni content of the body portion and less than 50 mass %, and has a thickness of 2 μm or greater and 45 μm or less. The coating layer is provided on a side peripheral surface of the high specific resistance layer, contains 50 mass % or more of Ni, and has a thickness of 3 μm or greater and 20 μm or less. The tip has a specific resistance of $20\times10^{-8}$ Ωm or less at room temperature.

7 Claims, 3 Drawing Sheets

SPARK PLUG

RELATED APPLICATIONS

This application is a National Stage of International Application No. PCT/JP16/02396 filed May 16, 2016, which claims the benefit of Japanese Patent Application No. 2015-108261, filed May 28, 2015, the entire contents of which are incorporated herein by reference.

FIELD OF THE INVENTION

The present invention relates to spark plugs. More particularly, the present invention relates to a spark plug with a tip provided on at least one of a center electrode and a ground electrode.

BACKGROUND OF THE INVENTION

In internal combustion engines, such as automotive engines, a spark plug is equipped with a center electrode and a ground electrode which are commonly made of Ni alloy, etc. Ni alloy has slightly less oxidation resistance and erosion resistance than those of a noble metal alloy containing noble metals such as Pt and Ir as a main component. However, the cost of Ni alloy is lower than that of noble metals, and therefore, is preferably used as a material for the ground and center electrodes.

The internal temperature of a combustion chamber has in recent years tended to be increased. Therefore, when spark discharge occurs between front end portions of the ground and center electrodes which are made of Ni alloy, etc., the erosion of the front end portions, facing each other, of the ground and center electrodes is likely to occur due to sparking. Therefore, in order to improve the erosion resistance of the ground and center electrodes, a technique has been developed in which a tip is provided on each of the front end portions, facing each other, of the ground and center electrodes, so that spark discharge occurs on these tips.

The tip is typically made of a material containing, as a main component, a noble metal having excellent oxidation resistance and spark erosion resistance. Examples of such a material include Ir, Ir alloy, and Pt alloy. A tip containing Ir as a main component is known to have excellent spark erosion resistance, and is also known to undergo abnormal erosion such that an outer peripheral surface of the tip which is not a discharge surface is hollowed into the shape of an arc. In order to inhibit such abnormal erosion, a tip has been proposed in which a coating layer containing Ni is provided on the surface of the body portion containing Ir as a main component (e.g., Japanese Patent Application Laid-Open (kokai) No. 2004-127681 and Japanese Patent Application Laid-Open (kokai) No. 2004-31300).

Incidentally, as to spark plugs, the internal temperature of a combustion chamber has in recent years tended to be increased in order to further improve the power output or fuel efficiency of an engine. When a technology such as a start-stop system is employed, the number of times an engine is turned on or off increases, and therefore, the number of heating/cooling cycles increases. In addition, the internal temperature range of the combustion chamber increases, for example. Thus, a spark plug is exposed to a harsher heating/cooling cycle environment. Furthermore, in order to improve the ignition performance or dielectric strength of an engine, a spark plug has been employed which is equipped with tips narrower than the ground and center electrodes. Therefore, compared to conventional spark plugs, the heating/cooling cycle environment is harsh for such a spark plug even when the traditional cycle from full throttle to idling is only repeatedly performed, assuming that the engine environment is the same. Therefore, the spark plug has begun to need durability at high temperature.

It has been found that when a spark plug for use in a combination of such a high temperature environment and harsh heating/cooling cycle environment is used for a long time so that the maintenance interval is elongated, then even if the spark plug is one equipped with a tip which is disclosed in Japanese Patent Application Laid-Open (kokai) No. 2004-127681 or Japanese Patent Application Laid-Open (kokai) No. 2004-31300, the abnormal erosion of the spark plug is unlikely to be inhibited. In other words, it has been found that when a spark plug is used in the above harsh environment, the abnormal-erosion resistance of the tip is likely to decrease after a predetermined period of time has elapsed.

An advantage of the present invention is a spark plug having excellent durability which is characterized in that a tip is provided on at least one of the center and ground electrodes of the spark plug, and when the spark plug is used in a combination of a high-temperature environment and a harsh heating/cooling cycle environment, the abnormal erosion of the tip is inhibited for a long time.

SUMMARY OF THE INVENTION

In accordance with a first aspect of the present invention, there is provided a spark plug including: a center electrode; a ground electrode with a gap being interposed between the center electrode and the ground electrode; and a tip provided on at least one of front end portions, facing each other, of the center electrode and the ground electrode, the tip extending along an axial line. The tip includes a body portion, a coating layer, and a high specific resistance layer. The body portion contains mostly Ir, and also contains 2 mass % or more of Rh or Pt, and none of group-A elements or a total content of the group-A elements of 24 mass % or less, the total content of the group-A elements excluding Ru being less than 7 mass %, where the group-A elements are metal elements having a crystal structure different from the crystal structure of Ir, Rh, and Pt at room temperature. The high specific resistance layer is provided on a side peripheral surface of the body portion, has a Ni content greater than the Ni content of the body portion and less than 50 mass %, and has a thickness of 2 μm or greater and 45 μm or less. The coating layer is provided on a side peripheral surface of the high specific resistance layer, contains 50 mass % or more of Ni, and has a thickness of 3 μm or greater and 20 μm or less. The tip has a specific resistance of $20\times10^{-8}$ Ωm or less at room temperature.

In accordance with a second aspect of the present invention, there is provided a spark plug, as described above, wherein the tip has a specific resistance of $10.5\times10^{-8}$ Ωm or greater at room temperature.

In accordance with a third aspect of the present invention, there is provided a spark plug, as described above, wherein the high specific resistance layer has a thickness of 2 μm or greater and 15 μm or less.

In accordance with a fourth aspect of the present invention, there is provided a spark plug, as described above, wherein the coating layer includes a Ni-rich layer containing 70 mass % or more of Ni, and the ratio (Tn/Th) of a thickness Tn of the Ni-rich layer to a thickness Th of the coating layer is 0.5 or greater.

In accordance with a fifth aspect of the present invention, there is provided a spark plug, as described above, wherein the body portion contains 0.6 mass % or more and 3 mass % or less of Ni.

In accordance with a sixth aspect of the present invention, there is provided a spark plug, as described above, wherein the body portion is an aggregation of crystal grains having a shape extending along the axial line, and the crystal grains have an aspect ratio of 2 or greater.

In accordance with a seventh aspect of the present invention, there is provided a spark plug, wherein the body portion contains at least Ir, Rh, and Ru of Ir, Rh, Ru, Re, and W, the content of Ir being 60 mass % or greater, the content of Rh being 6 mass % or greater and 32 mass % or less, and the content of Ru being 4 mass % or greater, and the total content of Ir, Ru, Re, and W being 93 mass % or less.

According to the present invention, a tip provided on at least one of a center electrode and a ground electrode includes a body portion having the above composition, a high specific resistance layer provided on a side peripheral surface of the body portion, and having the above composition and the above thickness, and a coating layer provided on a side peripheral surface of the high specific resistance layer, and having the above composition and the above thickness. The specific resistance of the tip at room temperature falls within a specific range. Therefore, even when the spark plug is used in a combination of a high temperature environment and a harsh heating/cooling cycle environment in which the number of heating/cooling cycles or the internal temperature range of a combustion chamber, etc., is increased due to the introduction of a start-stop system, the abnormal erosion of the tip in the side peripheral surface is inhibited for a long time. Therefore, a spark plug having excellent durability can be provided.

In particular, the body portion of the tip of the present invention contains mostly Ir in mass %, and also contains 2 mass % or more of Rh or Pt. Therefore, the tip has excellent oxidation resistance and spark erosion resistance.

The thermal conductivity of the body portion containing Ir as a main component tends to decrease with an increase in the total content of the group-A elements having a crystal structure different from that of Ir. Therefore, if the total content of the group-A elements exceeds 24 mass %, the temperature of the tip becomes high, so that the region of the high specific resistance layer is likely to increase, and therefore, the temperature of the tip is likely to become still higher, so that the abnormal-erosion resistance is likely to decrease. Meanwhile, the body portion of the tip of the present invention contains none of the metal elements of the group-A elements, or a total content of the group-A elements of 24 mass % or less, and therefore, easily maintains the thermal conductivity at a predetermined value, whereby the abnormal erosion can be inhibited. Ru is not easily oxidized, and the group-A elements excluding Ru are easily oxidized. Therefore, if the body portion contains 7 mass % or more of the group-A elements excluding Ru, oxidation proceeds between the body portion and the coating layer, and therefore, the coating layer is likely to peel off, resulting in the abnormal erosion. Meanwhile, the body portion of the tip of the present invention contains a total content of the group-A elements excluding Ru of less than 7 mass %, the oxidation between the body portion and the coating layer can be inhibited, and therefore, the peeling off of the coating layer can be inhibited, resulting in the inhibition of the abnormal erosion.

The high specific resistance layer in the present invention has a Ni content greater than the Ni content of the body portion and less than 50 mass %, and has a thickness of 2 μm or greater and 45 μm or less, and therefore, the abnormal erosion can be inhibited. The high specific resistance layer has a high specific resistance. Therefore, as the thickness of the high specific resistance layer increases, the temperature of the tip more easily becomes high. As the temperature of the tip increases, element diffusion further proceeds, so that the thickness of the high specific resistance layer further increases, and therefore, the temperature of the tip becomes still higher, resulting in a vicious cycle. However, the high specific resistance layer in the present invention has a thickness of 45 μm or less. Therefore, the temperature of the tip is less likely to become high during an early period of use, so that the element diffusion is less likely to proceed, and therefore, the above vicious cycle is less likely to occur. As a result, the abnormal erosion can be inhibited for a long time. If the thickness of the high specific resistance layer is excessively small, the difference in thermal expansion coefficient between the body portion and the coating layer cannot be absorbed, and therefore, the coating layer is likely to peel off.

The coating layer in the present invention contains 50 mass % or more of Ni, and has a thickness of 3 μm or greater and 20 μm or less, and therefore, the abnormal erosion can be inhibited. If the thickness of the coating layer exceeds 20 μm, the coating layer is likely to peel off the body portion, resulting in the abnormal erosion.

If the specific resistance of the tip at room temperature exceeds $20\times10^{-8}$ Ωm, the transfer of heat from the tip to the ground electrode and the center electrode is inhibited, and therefore, the element diffusion between the body portion and the coating layer is accelerated, and the region of the high specific resistance layer increases, so that the temperature of the tip becomes high, resulting in a decrease in the abnormal-erosion resistance. Meanwhile, the tip has a specific resistance of $20\times10^{-8}$ Ωm or less at room temperature, and therefore, the abnormal erosion can be inhibited.

BRIEF DESCRIPTION OF THE DRAWINGS

FIG. 3(*a*) is a schematic explanatory diagram showing a tip viewed laterally. FIG. 3(*b*) is a schematic explanatory diagram showing analysis points on a cut surface obtained by cutting the tip of FIG. 3(*a*) along a plane orthogonal to an axial line A.

DETAILED DESCRIPTION OF THE INVENTION

Figure 1:
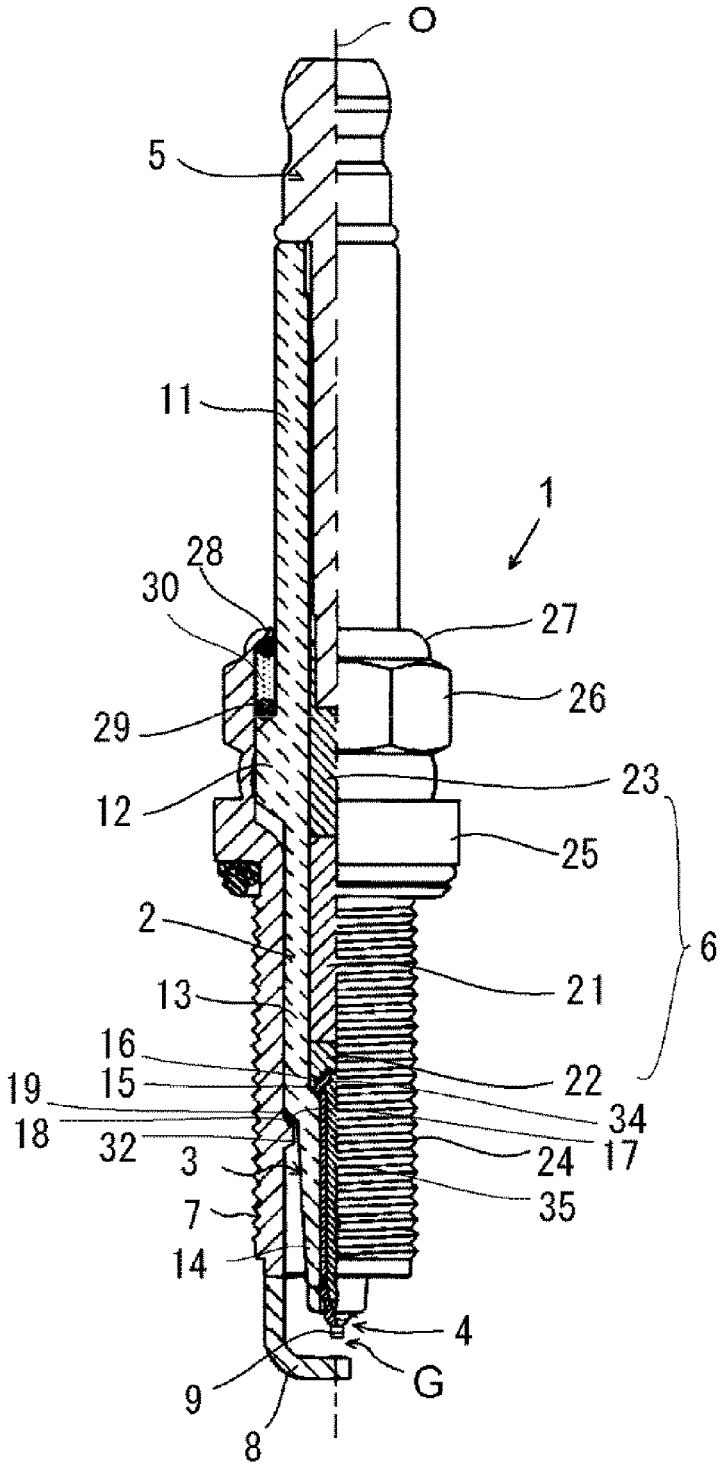
FIG. 1 is a partial cross-sectional view of a spark plug according to an example of the present invention.

FIG. 1 shows a spark plug according to an example of the present invention. FIG. 1 is a partial cross-sectional view of a spark plug 1 according to an example of the present invention. It is assumed that, in FIG. 1, a lower portion of the drawing sheet, i.e. a side on which a ground electrode described below is provided, is the direction of the front end of an axial line O, and an upper portion of the drawing sheet is the direction of the rear end of the axial line O.

As shown in FIG. 1, the spark plug 1 includes: an insulator 3 which has a substantially cylindrical shape and which has an axial hole 2 extending along the axial line O; a center electrode 4 which has a substantially bar shape and which is provided in the axial hole 2 at a front end portion thereof; a metal terminal 5 provided in the axial hole 2 at a rear end portion thereof; a connection part 6 which electrically connects the center electrode 4 with the metal terminal 5 in the axial hole 2; a metal shell 7 which has a substantially cylindrical shape and which holds the insulator 3; and a ground electrode 8 having an end joined to a front end portion of the metal shell 7 and another end facing the center electrode 4 with a gap G being interposed therebetween. A tip 9 is provided on a side surface of a front end portion of the ground electrode 8.

The insulator 3 has the axial hole 2 extending along the axial line O, and has a substantially cylindrical shape. The insulator 3 includes a rear trunk portion 11, a large diameter portion 12, a front trunk portion 13, and a leg portion 14. The rear trunk portion 11 accommodates the metal terminal 5, and insulates the metal terminal 5 from the metal shell 7. The large diameter portion 12 is located in front of the rear trunk portion, protruding outward in a radial direction. The front trunk portion 13 is located in front of the large diameter portion 12, accommodates the connection part 6, and has an outer diameter smaller than that of the large diameter portion 12. The leg portion 14 is located in front of the front trunk portion 13, accommodates the center electrode 4, and has an outer diameter and an inner diameter smaller than those of the front trunk portion 13. The inner peripheral surfaces of the front trunk portion 13 and the leg portion 14 are coupled together with a shelf portion 15 being interposed therebetween. A flange portion 16 of the center electrode 4 described below is in contact with the shelf portion 15 so that the center electrode 4 is fixed in the axial hole 2. The outer peripheral surfaces of the front trunk portion 13 and the leg portion 14 are coupled together with a step portion 17 being interposed therebetween. A tapered portion 18 of the metal shell 7 described below is in contact with the step portion 17 with a plate packing 19 being interposed therebetween so that the insulator 3 is fixed to the metal shell 7. The insulator 3 is fixed to the metal shell 7 with a front end portion of the insulator 3 protruding from a front end surface of the metal shell 7. The insulator 3 is desirably made of a material having high mechanical strength, thermal strength, and electrical strength. Such a material may be, for example, a sintered ceramic material containing alumina as a main component.

In the axial hole 2 of the insulator 3, the center electrode 4 is provided on the front side thereof, the metal terminal 5 is provided on the rear side thereof, and the connection part 6 is provided between the center electrode 4 and the metal terminal 5. The connection part 6 fixes the center electrode 4 and the metal terminal 5 in the axial hole 2 and also electrically connects them together. The connection part 6 includes a resistor 21, a first seal body 22, and a second seal body 23. The resistor 21 is provided in order to reduce noise propagation. The first seal body 22 is provided between the resistor 21 and the center electrode 4. The second seal body 23 is provided between the resistor 21 and the metal terminal 5. The resistor 21 is formed by sintering a composition containing glass powder, non-metal conductive powder, and metal powder, etc., and typically has a resistance value of 100Ω or greater. The first seal body 22 and the second seal body 23 are formed by sintering a composition glass powder and metal powder, etc., and typically have a resistance value of 100 mΩ or less. Although the connection part 6 of this embodiment includes the resistor 21, the first seal body 22, and the second seal body 23, the connection part 6 may include at least one of the resistor 21, the first seal body 22, and the second seal body 23.

The metal shell 7, which has a substantially cylindrical shape, is formed so that the insulator 3 is mounted and held inside the metal shell 7. The metal shell 7 has a screw portion 24 formed on the outer peripheral surface of a front portion thereof. By utilizing the screw portion 24, the spark plug 1 is attached to the cylinder head of an internal combustion engine (not shown). The metal shell 7 has a flange-like gas seal portion 25 located behind the screw portion 24, a tool engagement portion 26 which is for engaging with a tool such as a spanner or wrench and which is located behind the gas seal portion 25, and a crimping portion 27 located behind the tool engagement portion 26. Ring-shaped packings 28 and 29 and a talc 30 are provided in an annular space formed between the inner peripheral surfaces of the crimping portion 27 and the tool engagement portion 26 and the outer peripheral surface of the insulator 3 so that the insulator 3 is fixed to the metal shell 7. The screw portion 24 and the leg portion 14 are arranged so that a space is provided between a front end portion of the inner peripheral surface of the screw portion 24 and the leg portion 14. The tapered portion 18 which has a diameter becoming wider and is provided on the rear side of a projection 32 projecting inward in the radial direction is in contact with the step portion 17 of the insulator 3 with the annular plate packing 19 being interposed therebetween. The metal shell 7 can be made of a conductive steel material, such as low-carbon steel.

The metal terminal 5 is used to externally apply, to the center electrode 4, a voltage for causing spark discharge between the center electrode 4 and the ground electrode 8. The metal terminal 5 is inserted in the axial hole 2 and fixed by the second seal body 23 with a portion of the metal terminal 5 being exposed from the rear end of the insulator 3. The metal terminal 5 can be made of a metal material, such as low-carbon steel.

The center electrode 4 has a rear end portion 34 which is in contact with the connection part 6, and a rod-like portion 35 which extends forward from the rear end portion 34. The rear end portion 34 has the flange portion 16 protruding outward in the radial direction. The flange portion 16 is in contact with the shelf portion 15 of the insulator 3. A space between the inner peripheral surface of the axial hole 2 and the outer peripheral surface of the rear end portion 34 is filled by the first seal body 22. Therefore, the center electrode 4 is fixed in the axial hole 2 of the insulator 3 with the front end of the center electrode 4 protruding from the front end surface of the insulator 3, and is insulated from the metal shell 7. The rear end portion 34 and the rod-like portion 35 of the center electrode 4 can be made of a known material which is used for the center electrode 4, such as Ni alloy. The center electrode 4 may include: an outer layer made of a Ni alloy, etc.; and a core portion which is made of a material having a thermal conductivity higher than that of the Ni alloy, and which is concentrically buried in a center axial portion inside the outer layer. The core portion can be made of a material such as Cu, Cu alloy, Ag, Ag alloy, or pure Ni.

The ground electrode 8, which has, for example, a substantially prismatic shape. The ground electrode 8 has an end portion which is joined to a front end portion of the metal shell 7 and which is bent at a middle point thereof into a substantially L-shape, and another end portion which faces a front end portion of the center electrode 4 with the gap G being interposed therebetween. The ground electrode 8 can be made of a known material which is used for the ground electrode 8, such as Ni alloy. In addition, as with the center electrode 4, the ground electrode 8 may have a core portion which is provided in a center axial portion thereof and is made of a material having a thermal conductivity higher than Ni alloy.

Figure 5:
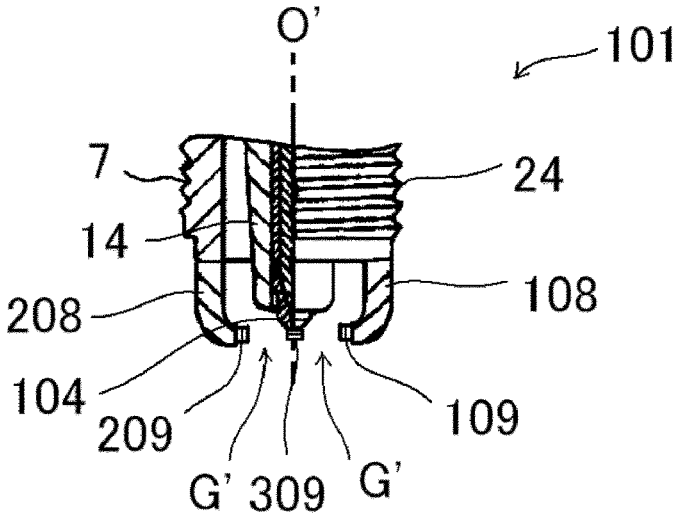
FIG. 5 is a partial cross-sectional view of a spark plug according to another example of the present invention.

In this embodiment, the tip 9 has a cylindrical shape, and is provided on only the center electrode 4. The shape of the tip 9 is not particularly limited. The tip 9 may be provided on only the ground electrode 8, or on each of the center electrode 4 and the ground electrode 8. In addition, it is only necessary that at least one of the tips provided on the center electrode 4 and the ground electrode 8 is made of a material having characteristics described below, and the other tip may be made of a known material which is used for a tip. The tip 9 is joined to the front end of the center electrode 4 by an appropriate technique, such as laser welding or resistance welding. In this embodiment, the gap G in the spark plug 1 is a shortest distance between the tip 9 provided on the center electrode 4 and the ground electrode 8. The gap G is typically set to 0.3 to 1.5 mm. As shown in FIG. 5, in a case of a spark plug 101 in which front end surfaces of tips 109 and 209 provided on ground electrodes 108 and 208 face a side surface of a tip 309 provided on a center electrode 104, a space having a shortest distance between a surface of the tip 109 provided on a front end portion of the ground electrode 108 and a surface of the tip 309 provided on the center electrode 104, that face each other, is a gap G'. Spark discharge occurs in the gap G'.

The tip, which is a characteristic feature of the present invention, will now be described in detail.

Figure 2:
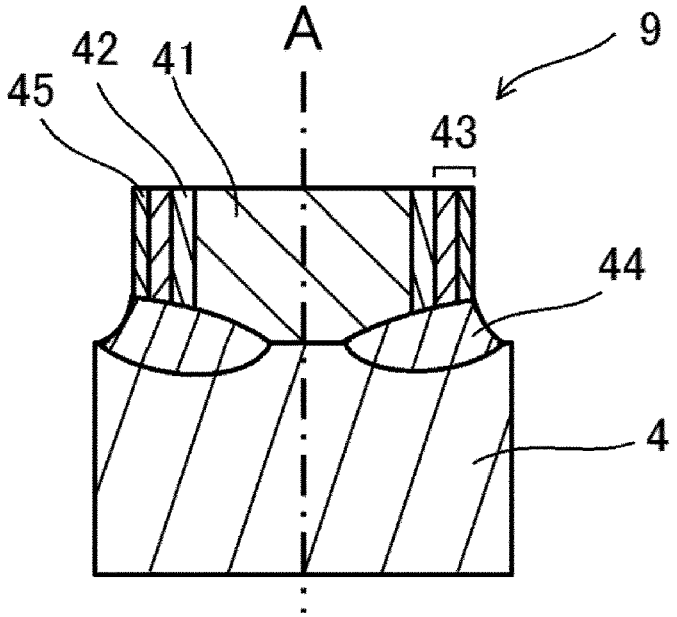
FIG. 2 is an enlarged cross-sectional view of a tip in the spark plug of FIG. 1 for describing main parts thereof.

As shown in FIG. 2, the tip 9 of this embodiment has: a body portion 41; a high specific resistance layer 42 provided on a side peripheral surface of the body portion 41, i.e. an outer peripheral surface in the radial direction of an axial line A extending from a center of the body portion 41 toward the gap G; and a coating layer 43 provided on the side peripheral surface of the high specific resistance layer 42, i.e. the outer peripheral surface in the radial direction of the axial line A.

The body portion 41 contains mostly Ir in mass %, and also contains 2 mass % or more of Rh or Pt. Preferably, the body portion 41 contains mostly Ir, and also contains 5 mass % or more of Rh or Pt. When the body portion 41 contains Ir and Rh or Pt within the above ranges, the tip 9 has excellent spark erosion resistance and oxidation resistance. In this case, however, if the entire surface of the body portion 41 is exposed, abnormal erosion described below is likely to occur. However, in the tip 9, the high specific resistance layer 42 and the coating layer 43 described below are provided on the side peripheral surface of the body portion 41, on which abnormal erosion is likely to occur, of the surface of the body portion 41, and therefore, the occurrence of abnormal erosion can be inhibited.

Abnormal erosion which occurs in the tip 9 will be firstly described. A tip which contains Ir as a main component and a predetermined amount of Rh or Pt has excellent spark erosion properties and oxidation resistance. However, when a spark plug is operated in a high-temperature combustion chamber for a long time, the tip may undergo abnormal erosion such that the side peripheral surface of the tip is hollowed into the shape of an arc. Such abnormal erosion proceeds on the side peripheral surface of the tip only in a predetermined direction, and therefore, it is considered that the flow of fluid in the combustion chamber is partly responsible for the abnormal erosion. In any case, the abnormal erosion is different from spark erosion which is erosion of the discharge surface of the tip 9 due to spark discharge. In addition, the abnormal erosion is different from simple oxidation erosion which is erosion of a portion of the entire surface of the tip due to oxidation of the tip. Therefore, a phenomenon that a specific portion of the tip 9 is eroded, which is different from spark erosion and oxidation erosion, is referred to as "abnormal erosion."

In order to inhibit such abnormal erosion, for example, Japanese Patent Application Laid-Open (kokai) No. 2004-127681 and Japanese Patent Application Laid-Open (kokai) No. 2004-31300 each disclose a tip containing Ir as a main component, and including a coating layer containing Ni on an outer peripheral surface in the radial direction of the body portion of the tip. In the background art, the abnormal erosion is inhibited by these tips. However, it has been found that, for example, when a spark plug for use in combination of a high temperature environment of as high as 1,000° C. and a harsh heating/cooling cycle environment, is used for a long time so that the maintenance interval is elongated, then if the spark plug is one equipped with a tip which is disclosed in Japanese Patent Application Laid-Open (kokai) No. 2004-127681 or Japanese Patent Application Laid-Open (kokai) No. 2004-31300, the abnormal erosion is less likely to be inhibited.

The present inventors have studied any causes of the above problem to find the followings. Specifically, when a spark plug which is equipped with a tip including a diffusion layer containing Ir and Ni which is formed by a thermal treatment so as to improve joinability between the tip body portion containing Ir as a main component and the coating layer containing Ni, is used in a combination of a high temperature environment and a harsh heating/cooling cycle environment, more and more mutual diffusion of the elements occurs with time between the body portion and the coating layer, which causes an increase in the region of the diffusion layer, and therefore, the elements more easily diffuse. The present inventors have considered that the accelerated increase in the region of the diffusion layer with duration of use is a cause of the decrease in abnormal-erosion resistance.

It is considered that the decrease in abnormal-erosion resistance due to an increase in the region of the diffusion layer is caused for the following two reasons. One of the two reasons is that as the region of the diffusion layer increases, the amount of Ni contained in the coating layer provided as the uppermost surface of the tip decreases relatively. It is considered that because the amount of Ni contained in the coating layer has a significant influence on the abnormal-erosion resistance, a decrease in the amount of Ni contained in the coating layer leads to a decrease in the abnormal-erosion resistance. The second reason is that Ni contained as a main component in the coating layer and Ir contained as a main component in the body portion have significantly different atomic radii, and therefore, the formed diffusion layer is likely to have a high specific resistance and therefore a low thermal conductivity. It is considered that the diffusion layer having a high specific resistance is formed with duration of use, and as the region of the diffusion layer increases, the temperature of the tip is more likely to become high, and therefore, the abnormal-erosion resistance is more likely to decrease. Thus, the present inventors have considered that to inhibit the increase in the diffusion layer with duration of use is effective in inhibiting the abnormal erosion of the tip in a harsh environment for a long time. In addition to this, the present inventors have taken into consideration various factors which have an influence on the abnormal erosion of the tip, such as the specific resistance of the tip at room temperature, and thereby have made the present invention. The diffusion layer formed by mutual diffusion of Ir and Ni has a specific resistance higher than those of the other portions, and therefore, is herein referred to as the "high specific resistance layer."

The body portion 41 contains either none of group-A elements or a total content of the group-A elements of 24 mass % or less, and the total content of the group-A elements excluding Ru being less than 7 mass %, where the group-A elements are metal elements having a crystal structure different from the crystal structure of Ir, Rh, and Pt at room temperature. The thermal conductivity of the body portion 41 tends to decrease as the content of the group-A elements increases. Therefore, when the total content of the group-A elements exceeds 24 mass %, the temperature of the tip 9 is likely to become high, so that the region of the high specific resistance layer 42 is likely to increase, and therefore, the temperature of the tip 9 is likely to become still higher, and therefore, the abnormal-erosion resistance is likely to decrease. Meanwhile, the body portion 41 contains none of the group-A elements or a total content of the group-A elements of 24 mass % or less, and therefore, easily maintains the thermal conductivity at a predetermined value, whereby the abnormal erosion can be inhibited. Ru is not easily oxidized, and the group-A elements excluding Ru are easily oxidized. Therefore, if the body portion 41 contains 7 mass % or more of the group-A elements excluding Ru, oxidation proceeds between the body portion 41 and the coating layer 43, and therefore, the coating layer 43 is likely to peel off, resulting in the abnormal erosion. Meanwhile, the body portion 41 contains a total content of the group-A elements excluding Ru of less than 7 mass %, the oxidation between the body portion 41 and the coating layer 43 can be inhibited, and therefore, the peeling off of the coating layer 43 can be inhibited, resulting in the inhibition of the abnormal erosion.

The crystal structure of Ir, Rh, and Pt at room temperature is the face-centered cubic lattice structure. The crystal structure of the group-A elements at room temperature is, for example, the hexagonal close-packed lattice structure or the body-centered cubic lattice structure, but not the face-centered cubic lattice structure. Examples of the group-A elements include Re, Ru, W, Nb, Mo, and Zr. The body portion 41 contains none of the group-A elements or at least one of the group-A elements within the above range.

The body portion 41 contains Ir, Rh, or Pt, and the group-A elements within the above range, and further contains at least Ir, Rh, and Ru of Ir, Rh, Ru, Re, and W, where, preferably, the Ir content is 60 mass % or greater, the Rh content is 6 mass % or greater and 32 mass % or less, the Ru content is 4 mass % or greater, and the total content of Ir, Ru, Re, and W is 93 mass % or less. As the temperature to which the tip 9 is exposed increases, the diffusion between the body portion 41 and the coating layer 43 is more likely to occur. In addition, the oxidation between the body portion 41 and the coating layer 43 is likely to occur, and the coating layer 43 is likely to break due to recrystallization and grain growth in the body portion 41 and the coating layer 43. As a result, the abnormal erosion is likely to occur. In addition, as the temperature to which the tip 9 is exposed increases, the influence of the difference in thermal expansion coefficient between the body portion 41 and the coating layer 43 increases, which results in the brittleness of the material, and therefore, the abnormal erosion is more likely to occur. If the Rh content of the body portion 41 is less than 6 mass %, then when the body portion 41 is used in an environment having a higher temperature, the oxidation between the body portion 41 and the coating layer 43 more easily proceeds, and therefore, the coating layer 43 is likely to peel off. If the Rh content of the body portion 41 exceeds 32 mass %, the coefficient of the mutual diffusion between the body portion 41 and the coating layer 43 increases, and therefore, the abnormal-erosion resistance is likely to decrease. If the Ru content of the body portion 41 is less than 4 mass %, the recrystallization temperature tends to decrease, and therefore, the recrystallization is likely to occur during use, so that the abnormal-erosion resistance is likely to decrease. If the body portion 41 contains at least Ir, Rh, and Ru of Ir, Rh, Ru, Re, and W, and the total content of Ir, Ru, Re, and W exceeds 93 mass %, the difference in thermal expansion coefficient between the body portion 41 and the coating layer 43 tends to increase, so that the coating layer 43 is likely to peel off, and therefore, the abnormal-erosion resistance is likely to occur. If the Ir content of the body portion 41 is less than 60 mass %, the body portion 41 or the high specific resistance layer 42 formed during use tends to be brittle, and the difference in thermal expansion coefficient between the body portion 41 and the coating layer 43 tends to increase, so that the coating layer 43 is likely to peel off, and therefore, the abnormal-erosion resistance is likely to decrease. Therefore, when the body portion 41 has the above composition, then even if the spark plug is used in a high temperature environment of, for example, higher than 1,000° C., the abnormal erosion of the tip 9 can be inhibited for a long time.

Preferably, the body portion 41 contains Ir, Rh or Pt, and the group-A elements within the above range, and also contains 0.6 mass % or more and 3 mass % or less of Ni. When the body portion 41 contains 0.6 mass % or more of Ni, the concentration gradient of Ni between the coating layer 43 and the body portion 41 decreases, and therefore, the diffusion of Ni from the coating layer 43 into the body portion 41 is easily inhibited. Therefore, a defect due to the diffusion of Ni is less likely to occur in the coating layer 43, and even when a defect such as a pinhole is present in the coating layer 43, the influence of the defect can be minimized, and therefore, the abnormal erosion can be inhibited. If the Ni content of the body portion 41 exceeds 3 mass %, the melting point of the body portion 41 decreases, so that the mutual diffusion coefficient increases, and therefore, the effect of inhibiting the diffusion which is achieved by Ni being contained in the body portion 41 decreases.

The body portion 41 is an aggregation of crystal grains having a shape extending along the axial line A. Preferably, the crystal grains have an aspect ratio of 2 or greater. More preferably, the body portion 41 is fibrous tissue. If the crystal grains included in the body portion 41 have an aspect ratio of less than 2, the number of grain boundaries in the vicinity of the interface between the body portion 41 and the coating layer 43 is larger than when the aspect ratio is 2 or greater, and therefore, Ni of the coating layer 43 more easily diffuse into the grain boundaries of the body portion 41. If Ni diffuses in the grain boundaries, a break is likely to occur from the grain boundaries due to thermal stress, which likely leads to a break in the coating layer 43. Meanwhile, if the crystal grains included in the body portion 41 have an aspect ratio of 2 or greater, a break is less likely to occur in the body portion 41 and the coating layer 43, and therefore, the abnormal erosion can be inhibited.

The aspect ratio of the crystal grains included in the body portion 41 can be determined as follows. Initially, the tip 9 is cut along a plane including the axial line A, and the cut surface is polished to obtain a polished surface. The polished surface is observed using a field emission scanning electron microscope (FE-SEM). A largest distance L between two points where a straight line parallel to the axial line A intersects with a crystal grain boundary, and a largest distance M between two points where a straight line perpendicular to the axial line A intersects with the crystal grain boundary, are measured. For each of a plurality of crystal grains, the largest distance L and the largest distance M are similarly measured, and L/M is calculated. The average value of the calculated values is defined as an aspect ratio of the crystal grains. The aspect ratio of the crystal grains in the body portion 41 can be adjusted by changing a working process (a working temperature, a working rate, etc.) of producing a core material for the body portion 41, or the temperature, duration, etc., of a thermal treatment for forming the diffusion layer (high specific resistance layer 42) between the body portion 41 and the coating layer 43.

The high specific resistance layer 42 is a region having a Ni content which is greater than that of the body portion 41 and is less than 50 mass %. The high specific resistance layer 42 is formed by mutual diffusion of elements contained in the body portion 41 and the coating layer 43, which is caused by a diffusion process step described below. The high specific resistance layer 42 has a thickness of 2 μm or greater and 45 μm or less, preferably 2 μm or greater and 15 μm or less. In the background art, as indicated by Patent Document 2, it has been considered that, in a tip which includes a body portion and a coating layer and also includes a diffusion layer previously formed by subjecting the tip to a diffusion process, the coating layer is less likely to peel off, compared to a tip which has not been subjected to a diffusion process, and as the region of the diffusion layer increases, the abnormal erosion can be inhibited while the peel resistance is enhanced. It is considered that the diffusion layer is required in order to maintain the peel resistance. As described above, spark plugs have in recent years been used in a combination of a high temperature environment and a harsh heating/cooling cycle environment for a long time. Under such conditions, the diffusion of elements between the body portion and the coating layer proceeds with time, so that the region of the diffusion layer previously formed between the body portion and the coating layer increases. As the region of the diffusion layer increases, the specific resistance of the diffusion layer increases according to Nordheim's rule, and therefore, the temperature of the tip becomes high. Specifically, it has been found that if the diffusion layer previously formed has a large region, the temperature of the tip becomes high during an early period of use, so that the diffusion layer having a high specific resistance becomes larger, resulting in a vicious cycle of the diffusion and the increase in temperature, and therefore, the abnormal-erosion resistance is likely to decrease. Meanwhile, in the tip 9, the high specific resistance layer 42 having a high specific resistance has a thickness of 45 μm or less, preferably 15 μm or less. Therefore, the temperature of the tip 9 is less likely to become high during an early period of use, so that the element diffusion is less likely to proceed, and therefore, the above vicious cycle is less likely to occur. As a result, the decrease in abnormal-erosion resistance can be inhibited. If the thickness of the high specific resistance layer 42 is excessively small, the difference in thermal expansion coefficient between the body portion 41 and the coating layer 43 cannot be absorbed, and therefore, the coating layer 43 is likely to peel off. Meanwhile, in the tip 9, the thickness of the high specific resistance layer 42 is within the above range, the temperature of the tip 9 can be inhibited from becoming high while the coating layer 43 is inhibited from peeling off, and therefore, the abnormal erosion can be inhibited.

The coating layer 43 contains 50 mass % or more of Ni, and has a thickness of 3 μm or greater and 20 μm or less. If the thickness of the coating layer 43 is less than 3 μm, the effect of inhibiting the abnormal erosion of the tip 9 is not achieved. If the thickness of the coating layer 43 exceeds 20 μm, the coating layer 43 is likely to peel off the body portion 41, resulting in the abnormal erosion. Meanwhile, in the tip 9, the coating layer 43 contains 50 mass % or more of Ni, and has a thickness of 3 μm or greater and 20 μm or less, and therefore, the decrease in abnormal-erosion resistance can be inhibited.

Preferably, the coating layer 43 includes a Ni-rich layer 45 containing 70 mass % or more of Ni, and the ratio (Tn/Th) of a thickness Tn of the Ni-rich layer 45 to a thickness Th of the coating layer 43 is 0.5 or greater. As the Ni content increases, the specific resistance decreases. Therefore, as the proportion of the Ni-rich layer 45 increases, the temperature of the tip 9 can be inhibited from becoming high. In addition, as the proportion of the Ni-rich layer 45 increases, a larger amount of Ni, which has excellent abnormal-erosion resistance, can be contained in the surface layer portion of the tip 9. Therefore, even when the element diffusion between the body portion 41 and the coating layer 43 proceeds, the decrease in Ni concentration of the Ni-rich layer 45 can be inhibited, so that the abnormal erosion can be inhibited.

The tip 9 has a specific resistance of $20\times10^{-8}$ Ωm or less at room temperature, preferably $10.5\times10^{-8}$ Ωm or greater. Even when the tip 9 has the body portion 41, the high specific resistance layer 42, and the coating layer 43 which have the above compositions and thicknesses, then if the specific resistance of the tip 9 is high at room temperature, the transfer of heat from the tip 9 to the center electrode 4 is inhibited, and therefore, the element diffusion between the body portion 41 and the coating layer 43 is accelerated, and the region of the high specific resistance layer 42 increases, so that the temperature of the tip 9 becomes high, resulting in a decrease in the abnormal-erosion resistance. Meanwhile, the tip 9 has a specific resistance of $20\times10^{-8}$ Ωm or less at room temperature, and therefore, heat is easily transferred from the tip 9 to the center electrode 4, so that the abnormal erosion can be inhibited. If the specific resistance of the tip 9 is excessively low at room temperature, then when the tip 9 is welded onto the center electrode 4, it is necessary to apply a large amount of heat in order to ensure sufficient weld strength. Therefore, if the specific resistance of the tip 9 is excessively low at room temperature, a portion of the coating layer 43 containing Ni, having a low melting point, is likely to melt during welding, and therefore, it is less likely to obtain the coating layer 43 which has a uniform thickness and composition.

The specific resistance of the tip 9 at room temperature can be adjusted by changing the composition, thickness, working process, etc., of each of the body portion, the high specific resistance layer, and the coating layer. In addition, when the body portion 41 is produced by sintering, or when the coating layer 43, etc., is produced by thermal spraying, etc., the specific resistance of the tip 9 at room temperature can be adjusted by changing a sintered density (calculated by dividing an actual density by a theoretical density) or a porosity. The specific resistance of the tip 9 at room temperature can be obtained as follows. Initially, the tip 9 is cut off the spark plug 1 along a plane parallel to the discharge surface of the tip 9, excluding a fusion portion 44 which is formed when the tip 9 is joined to the center electrode 4. A specific resistance between the discharge surface and the cut surface of the cut tip 9 can be determined by four-terminal sensing using an electrical resistance measuring device. When the tissue of the tip 9 is not changed before and after the tip 9 is joined to the spark plug 1, the specific resistance may be obtained using the tip 9 which has not yet been subjected to welding.

In the tip 9 of the present invention, the body portion 41, the high specific resistance layer 42, and the coating layer 43 may each contain a content of incidental impurities of less than 5 mass %. Examples of incidental impurities in the body portion 41 include Al, Si, Fe, and Cu, etc. Examples of incidental impurities in the coating layer 43 include Al, Si, Mn, and P. Examples of incidental impurities in the high specific resistance layer 42 include those contained in the body portion 41 and the coating layer 43. Although it is preferable that the content of these incidental impurities should be small, the incidental impurities may be contained within a range which allows the problem of the present invention to be solved. Assuming that the total mass of the above components is 100 parts by mass, the proportion of one of the above incidental impurities is preferably 0.1 parts by mass or less, and the total proportion of all incidental impurities contained is preferably 0.2 parts by mass or less.

The content of each component and thickness of each of the body portion 41, the high specific resistance layer 42, and the coating layer 43 can be determined by point analysis using a wavelength dispersive X-ray spectrometer (WDS) attached to an FE-EPMA.

Figure 3A:
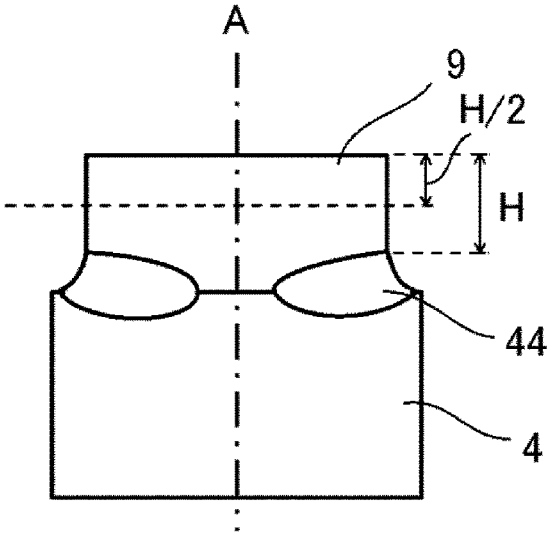
FIGS. 3(*a*) and 3(*b*) are explanatory diagrams showing a position where the composition of a tip is measured.
Figure 3B:
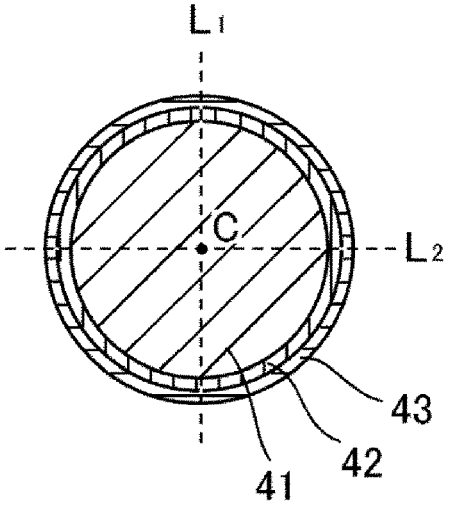
Figure 4:
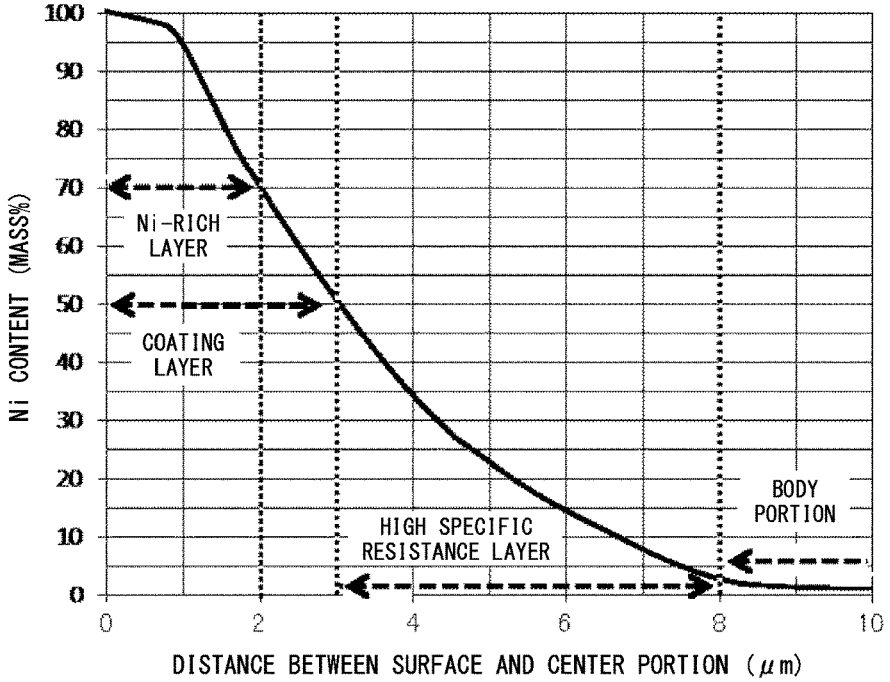
FIG. 4 is an explanatory diagram showing a relationship between a distance between a surface and a center portion of a tip, and the content of Ni.

Initially, as shown in FIG. 3(*a*), the tip is cut along a plane orthogonal to the axial line A, at half a height H from the front end surface of the tip to an end portion of the fusion portion 44 in a direction along the axial line A, so that a cut surface is exposed. In this embodiment, the tip 9 is cylindrical, and therefore, as shown in FIG. 3(*b*), a circular cut surface is obtained. The composition of the body portion 41 is determined by performing point analysis at a center portion C of the cut surface using a spot diameter of 100 μm. The composition and thickness of the coating layer 43, etc., provided on the side peripheral surface of the body portion 41 are determined by initially performing point analysis on two orthogonal lines $L_1$ and $L_2$ passing through the center portion C of the circular cut surface, from the four end portions toward the center portion C, i.e. in four directions. In this case, the point analysis is performed at intervals of 1 μm using a spot diameter of 1 μm. Assuming that a region having a Ni content of 50 mass % or greater is the coating layer 43, lengths of the region are measured. Assuming that a region having a Ni content which is less than 50 mass % and is greater than that of the body portion 41 by 1 mass % or more is the high specific resistance layer 42, lengths of the region are measured. The average values of the lengths measured on the four lines of the regions of the coating layer 43 and the high specific resistance layer 42 are defined as thicknesses of the coating layer 43 and the high specific resistance layer 42, respectively. If there is a region having a Ni content of 70 mass % or greater, it is assumed that the region is the Ni-rich layer 45, and lengths of the region are measured. The average value of the lengths measured on the four lines of the region is defined as a thickness of the Ni-rich layer 45. The high specific resistance layer 42 is formed by mutual element diffusion between the body portion 41 and the coating layer 43, which is caused by a diffusion treatment step described below. Therefore, as shown in FIG. 4, typically, the Ni contents of the Ni-rich layer 45, the coating layer 43, and the high specific resistance layer 42 decrease from the surface of the tip 9 toward the center portion C, and have their respective graded compositions.

The coating layer 43 may be provided on a portion of the entire surface of the body portion 41 on which the abnormal erosion is likely to occur. For example, the coating layer 43 may be provided on at least a side peripheral surface. While the coating layer 43 may be provided throughout the entire surface of the body portion 41, it is preferable that the coating layer 43 should not be provided on the discharge surface facing the gap G or the bottom surface joined to the center electrode 4. Specifically, it is preferable that the bottom surface of the tip 9 where the body portion 41 is exposed should be brought into contact with the center electrode 4, and the tip 9 and the center electrode 4 should be joined together by resistance welding, laser welding, or resistance welding followed by laser welding. The abnormal erosion does not occur in the bottom surface of the tip 9, which is joined to the center electrode 4, and therefore, even if the coating layer 43 is provided on the bottom surface of the tip 9, the feature of the present invention is not obtained. In addition, if the coating layer 43 is provided on the bottom surface of the tip 9, which is joined to the center electrode 4, then when the tip 9 is joined to the center electrode 4 by resistance welding, laser welding, or both thereof, the tip 9 and the center electrode 4 are melted, and molten grains are likely to scatter and adhere to portions around the joint portion, so that the quality of the spark plug 1 is not likely to be maintained, leading to a manufacturing defect. Therefore, it is preferable that at least a portion of the bottom surface of the tip 9, which is joined to the center electrode 4, should be formed by the body portion 41. It is more preferable that the bottom surface of the tip 9, which is joined to the center electrode 4, should be entirely formed only by the body portion 41. The abnormal erosion does not occur in the discharge surface of the tip 9. Therefore, even if the coating layer 43 is provided on the discharge surface of the tip 9, the feature of the present invention is not obtained.

Although the tip 9 is cylindrical in this embodiment, the shape of the tip 9 is not particularly limited. The tip 9 can have any other suitable shape, such as an elliptic cylindrical, prismatic, or plate-like shape. As the tip 9 is narrowed so that the area of a cross-section thereof taken along a plane orthogonal to the axial line A decreases, the ignition performance and dielectric strength of an engine are further improved, although the temperature of the tip 9 is more likely to become high, and the abnormal erosion is more likely to occur. However, the tip 9 has the above properties, and therefore, even when the tip 9 is narrowed, the abnormal erosion can be inhibited, compared to conventional tips.

The spark plug 1 is, for example, produced as follows. A method for producing the tip 9 includes a step of producing a core material which is to be the body portion 41, a step of forming a Ni-containing layer which is to be the coating layer 43 on a surface of the core material to obtain a surface Ni member, and a step of performing a diffusion treatment on the surface Ni member.

In the step of producing a core material which is to be the body portion 41, initially, a raw material powder containing a mixture of metal components within the above content ranges is prepared. The powder is arc-melted to form an ingot, which is then hot-forged into a rod material. Next, the rod material is rolled a plurality of times using grooved rolls, optionally followed by swaging. The resultant material is subjected to wire drawing using a drawing die, and is thereby formed into a round rod material having a circular cross-section. The resultant material is a core material.

Next, a Ni-containing layer which is to be the coating layer 43 is formed on a surface of the core material. The round rod material on which the Ni-containing layer is formed is cut into a desired length. Thus, a surface Ni member including the core material having the Ni-containing layer on the surface thereof is produced. Alternatively, the surface Ni member may be produced by cutting the core material into a predetermined length and then forming the Ni-containing layer which is to be the coating layer 43. The shape of the core material which is to be the body portion 41 is not limited to a cylindrical shape. Alternatively, for example, the ingot may be subjected to wire drawing using a quadrangular die to produce a prismatic core material.

Examples of the technique of forming the Ni-containing layer on the surface of the core material include, but are not limited to, electroplating, electroless plating, chemical vapor deposition, physical vapor deposition, and joining a different material (cladding material) around the core material (e.g., attaching a cylindrical material to the core material), etc.

When the Ni-containing layer is formed on the surface of the core material by electroplating or electroless plating, conditions for the plating, such as plating bath composition, current value, voltage value, and thermal treatment conditions, are controlled so that the Ni-containing layer having the above composition is formed. Platings having different compositions may be successively formed into a multilayer structure on the surface of the core material. Examples of chemical vapor deposition (CVD) include MOCVD, PECVD, LPCVD, atmospheric pressure CVD, and CCVD, etc. Examples of physical vapor deposition (PVD) include various sputtering techniques, such as vacuum vapor deposition, DC sputtering, and high-frequency sputtering, various ion plating techniques, such as high-frequency ion plating, molecular beam epitaxy, laser ablation, ionized cluster beam vapor deposition, ion beam vapor deposition, and various thermal spraying techniques, etc. The above techniques may be used in combination, or the same technique may be repeatedly performed. A diffusion treatment described below may be performed between each treatment.

Examples of the method for forming a Ni-containing layer on a portion of the entire surface of the core material so that the tip 9 in which a portion of the body portion 41 is exposed is produced, include: a method of forming a Ni-containing layer throughout the entire surface of the core material, and then cutting the core material having the Ni-containing layer along a plane perpendicular to the axial line of the core material, to produce a tip in which a portion of the body portion is exposed; and a method of forming a Ni-containing layer throughout the entire surface of the core material, and then shaving, cutting, etc., a portion of the Ni-containing layer so that a tip in which a body portion is exposed at any portion of the tip is formed.

Next, the surface Ni member is subjected to a diffusion treatment. As a result, elements contained in the core material which is to be the body portion 41 and the Ni-containing layer which is to be the coating layer 43 mutually diffuse, so that the high specific resistance layer 42 is formed. The diffusion treatment step is performed by maintaining the surface Ni member at a temperature of, for example, 600-1300° C. for 0-10 h. To maintain the surface Ni member for 0 h means to cool the surface Ni member immediately after increasing the temperature of the surface Ni member. The heating technique is not particularly limited. The surface Ni member may be heated by controlling the atmosphere using an electrical furnace, or may be heated using a burner. The thermal treatment step may be performed a plurality of times.

When a tip is joined to the center electrode 4, the tip may be produced in a manner similar to that for the tip 9 which is joined to the ground electrode 8, or may be produced using a known technique.

The center electrode 4 and the ground electrode 8 can, for example, be produced by formulating a molten alloy having a desired composition using a vacuum melting furnace, and subjecting the alloy to wire drawing, etc., while adjusting to a predetermined shape and predetermined dimensions as appropriate. When the center electrode 4 includes an outer layer and a core portion buried in an central axis portion of the outer layer, the center electrode 4 is formed by inserting, into a cup-shaped outer material made of a Ni alloy, etc., an inner material made of a Cu alloy, etc., having a thermal conductivity higher than that of the outer material, and subjecting the resultant material to plastic working, such as extrusion, to form the center electrode 4 having a core portion inside an outer layer. The ground electrode 8 may include an outer layer and a core portion as with the center electrode 4. In this case, as with the center electrode 4, the ground electrode 8 can be formed by inserting an inner material into a cup-shaped outer material, subjecting the resultant material to plastic working, such as extrusion, and subjecting the resultant material to plastic working and thereby forming the resultant material into a substantially prismatic shape.

Next, an end portion of the ground electrode 8 is joined to an end surface of the metal shell 7 which is formed into a predetermined shape by plastic working, etc., by electric resistance welding, laser welding, etc. Next, the metal shell 7 to which the ground electrode 8 is joined is subjected to Zn plating or Ni plating. After the Zn plating or Ni plating, a trivalent chromate treatment may be performed. The plating formed on the ground electrode may be removed.

Next, the tip 9 thus prepared is fixed to the center electrode 4 through a fusion process by resistance welding and/or laser welding, etc. When the tip 9 is joined to the center electrode 4 by resistance welding, the tip 9 is placed at a predetermined position of the center electrode 4, and resistance welding is performed while the tip 9 is pressed against the center electrode 4, for example. When the tip 9 is joined to the center electrode 4 by laser welding, the tip 9 is placed at a predetermined position of the center electrode 4, a contact portion between the tip 9 and the center electrode 4 is irradiated with a laser beam, partially or all the way therearound in a direction parallel to the contact surface between the tip 9 and the center electrode 4, for example. After resistance welding is performed, laser welding may be performed. When the tip 9 in which the coating layer 43 is provided throughout the entire surface of the body portion 41 is joined to the center electrode 4, the tip 9 and the center electrode 4 are melted, and molten grains are likely to scatter and adhere to portions around the joint portion, so that the quality of the spark plug is not likely to be maintained, leading to a manufacturing defect. Meanwhile, in the case of the tip 9 in which the coating layer 43 is not provided on a surface of the tip 9 which is to be joined to the center electrode 4 and from which the body portion 41 is exposed, when the tip 9 is joined to the center electrode 4, the scattering of molten grains of the tip 9 and the center electrode 4 can be inhibited, and therefore, the number of spark plugs having a manufacturing defect can be reduced. Therefore, considering the reduction of the number of spark plugs having a manufacturing defect, it is preferable that the body portion should be exposed from a surface of the tip 9 which is joined to the center electrode 4. A tip can be joined to the ground electrode 8 in a manner similar to that of joining the tip 9 to the center electrode 4.

Meanwhile, the insulator 3 having a predetermined shape is produced by sintering a ceramic material, etc. The center electrode 4 is inserted into the axial hole 2 of the insulator 3. A composition for forming the first seal body 22, a composition for forming the resistor 21, and a composition for forming the second seal body 23 are loaded into the axial hole 2 in that order while being preliminarily compressed. Next, these compositions are compressed and heated while the metal terminal 5 is being inserted and pressed against the compositions from an end portion in the axial hole 2. Thus, the compositions are sintered to form the resistor 21, the first seal body 22, and the second seal body 23. Next, the insulator 3 to which the center electrode 4, etc., are fixed is attached to the metal shell 7 to which the ground electrode 8 is joined. Finally, a front end portion of the ground electrode 8 is bent toward the center electrode 4 so that an end of the ground electrode 8 faces a front end portion of the center electrode 4. Thus, the spark plug 1 is produced.

The spark plug 1 according to the present invention is used as an ignition plug for an automotive internal combustion engine, such as a gasoline engine. The spark plug 1 is fixed at a predetermined position by the screw portion 24 being screwed into a screw hole provided in a head (not shown) delimiting a combustion chamber of an internal combustion engine. The spark plug 1 according to the present invention can also be used for any internal combustion engines. Even when the spark plug 1 according to the present invention is used in a combination of a high temperature environment and a harsh heating/cooling cycle environment, the occurrence of the abnormal erosion on the side surface of the tip can be inhibited for a long time. Therefore, the spark plug 1 according to the present invention is particularly suitable for an internal combustion engine, in which the spark plug is exposed to the above harsh environment.

The spark plug 1 according to the present invention is not limited to the above examples. Various changes and modifications can be made to the above examples without departing from the scope of the present invention. For example, in the spark plug 1, a front end surface of the tip 9 provided on the center electrode 4 faces a side surface of a front end portion of the ground electrode 8 in a direction along the axial line O with the gap G being interposed therebetween. Alternatively, in the present invention, as shown in FIG. 5, a side surface of the tip 309 provided on the center electrode 104 faces front end surfaces of the tips 109 and 209 provided on the ground electrodes 108 and 208 in a radial direction of the center electrode with the gap G' being interposed therebetween. In this case, there may be one or more ground electrodes provided, facing a side surface of the tip 309 provided on the center electrode.

Examples

1. Evaluation Test I on Abnormal-Erosion Resistance

Production of Spark Plug Test Body

Tips were each produced as follows: a core material which was to be the body portion was produced; a Ni-containing layer (test no. 14: an Au-containing layer) was formed on a surface of the core material by electroplating, or joining a different material (cladding), to obtain a surface Ni member; and the surface Ni member was subjected to a diffusion treatment. Only elements contained in the body portion were contained in the coating layer in addition to Ni and incidental impurity.

A Ni-containing layer was formed by electroplating as follows. A raw material powder having a predetermined composition was prepared. The powder was arc-melted to form an ingot, which was then subjected to hot forging, hot rolling, and hot swaging, and wire drawing, to form a round rod material having a predetermined length, which is a core material. A Ni-containing layer having a predetermined composition was formed on a peripheral side surface of the round rod material by electroplating. Thereafter, the rod material was cut into a predetermined length. As a result, a cylindrical surface Ni member having a diameter of 0.6 mm and a height of 0.7 mm was obtained.

A Ni-containing layer was formed by joining a different material (cladding) as follows. A raw material powder having a predetermined composition was prepared. The powder was arc-melted to form an ingot, which was then subjected to hot forging, hot rolling, and hot swaging, and wire drawing, to form a round rod material having a predetermined length, which is a core material. A cylindrical material corresponding to a Ni-containing layer having a predetermined composition was attached to a peripheral side surface of the round rod material, followed by wire drawing. The resultant structure was cut into a predetermined length. Thus, a cylindrical surface Ni member having a diameter of 0.6 mm and a height of 0.7 mm was obtained.

Next, the diffusion treatment was performed as follows. The surface Ni member was placed in an electrical furnace. The internal temperature of the electrical furnace was kept at a predetermined temperature falling within the range of 600-1300° C. for a predetermined time falling within the range of 0-10 h. The diffusion treatment caused mutual diffusion of elements between the core material and the Ni-containing layer, so that a high specific resistance layer was formed. Thus, a tip having the body portion, the high specific resistance layer, and the coating layer was formed. In order to impart a desired configuration to some of the samples obtained by electroplating, a diffusion treatment was performed after electroplating, and thereafter, electroplating was further performed to obtain the above cylindrical surface Ni member, which was then subjected to a diffusion treatment. In some samples, in order to cause the body portion after the diffusion treatment to have crystal grains having an aspect ratio of 2 or greater, the temperature, time, etc., of the thermal treatment were adjusted so that the body portion does not undergo recrystallization.

The tip thus obtained was joined to a center electrode made of Inconel 600 and having a diameter of 1.9 mm at the rod-like portion located in front of the flange portion, by resistance welding and then laser welding. Thus, a spark plug test body having the structure of FIG. 1 was produced.

Method of Measuring Composition of Tip and Thicknesses of Coating Layer, Etc.

The mass composition of each tip was measured by WDS analysis using an FE-EPMA (JXA-8500F, manufactured by JEOL Ltd.). The composition of the body portion was measured as described above. Specifically, the body portion was cut along a plane orthogonal to the axial line A, and point analysis was performed at the center portion C of the cut surface (accelerating voltage: 20 kV, spot diameter: 100 μm). As described above, the composition and thickness of the coating layer, etc., were determined by performing point analysis on two orthogonal lines $L_1$ and $L_2$ passing through the center portion C of the cut surface, from the respective end portions toward the center portion C, i.e. in four directions, from a position which is 1 μm inside from each end portion (accelerating voltage: 20 kV, spot diameter: 100 μm, interval: 1 μm). Assuming that, as shown in FIG. 4, a region having a Ni content of 70 mass % or greater is a Ni-rich layer, a region having a Ni content of 50 mass % or greater is a coating layer, and a region having a Ni content which is less than 50 mass % and is greater than the Ni content of the body portion by 1 mass % or more is a high specific resistance layer, the average values of the lengths measured on the four lines of the regions of the Ni-rich layer, the coating layer, and the high specific resistance layer were defined as thicknesses of the Ni-rich layer, the coating layer, and the high specific resistance layer, respectively. The ratio (Tn/Th) of a thickness Tn of the Ni-rich layer and a thickness Th of the coating layer was calculated. A case where the ratio (Tn/Th) is 0.5 or greater is indicated by an open circle in Table 1.

Method of Measuring Specific Resistance

The specific resistance of each tip at room temperature was determined by measuring it 10 times by four-terminal sensing using an electrical resistance measuring device (3541 RESISTANCE HiTESTER, manufactured by HIOKI E. E. Corporation) and averaging 10 measured values.

Method of Measuring Aspect Ratio of Crystal Grains

The aspect ratio of crystal grains included in a body portion was measured as follows. Initially, a tip was cut along a plane including the axial line A, and a cut surface was polished to obtain a polished surface. The polished surface was subjected to a cross-section polisher process (SM-09010, manufactured by JEOL Ltd.) or an ion milling process (IM-4000, manufactured by Hitachi High-Technologies Corporation). A composition image of the resultant cross-section was observed using a field emission scanning electron microscope (FE-SEM) (JSM-6330F, manufactured by JEOL Ltd.). A largest distance L between two points where a straight line parallel to the axial line A intersects with a crystal grain boundary, and a largest distance M between two points where a straight line perpendicular to the axial line A intersects with the crystal grain boundary, were measured. For each of five or more crystal grains, the largest distance L and the largest distance M were similarly measured, and L/M was calculated. The average value of the calculated values was defined as an aspect ratio of the crystal grains. An aspect ratio of 2 or greater is defined as "large" and an aspect ratio of less than 2 is defined as "small" in Table 1.

Method for Evaluation Test on Abnormal-Erosion Resistance

Each produced spark plug test body was attached to an engine for testing. The engine was run at full throttle and at a rotational speed of 6,000 rpm. The temperature at a position which is 0.5 mm away from a front end portion of the center electrode, as measured using a thermocouple, was adjusted to 1,000° C. The engine was run at full throttle for 10 min and then stopped for 2 min. This operation was repeatedly performed until a total period of time during which the engine was at full throttle reached 200 h. This test is referred to as "endurance test A".

In the endurance test A, a cross-sectional image of each tip was taken along a plane orthogonal to the axial line A using a CT scanner (TOSCANER-32250 μhd, manufactured by Toshiba Corporation). When a portion of the tip was hollowed from the side surface, and the hollowed portion had a largest length of 0.02 mm in the radial direction of the tip, it was determined that the abnormal erosion occurred, and at this timing, abnormal erosion start time X was measured. According to the abnormal erosion start time X, the abnormal-erosion resistance of the tip was evaluated as follows. The results are shown in Table 1.

Cross: the time X was 50 h
Open circle: the time X was 100 h
Double circle: the time X was 110 h
Open star: the time X was 120 h
Solid star: the time X was 130 h
Two open stars: the time X was 160 h
One solid star and one open star: the time X was 180 h
Two solid stars: the time X was 200 h

TABLE 1

| | | Composition of body section (mass %) | | | | | | | | | | |
|---|---|---|---|---|---|---|---|---|---|---|---|---|
| Test no. | Specific resistance ($10^{-8}$ Ωm) | Ir | Rh | Ru | Re | W | Pt | Ni | Co | Pd | Total content of group-A elements | Total content of group-A elements excluding Ru |
| 1 | 14.9 | 95.0 | 20.0 | 15.0 | | | 1.0 | | | | 15.0 | 0.0 |
| 2 | 28.1 | 57.0 | 30.0 | | | 12.0 | | 1.0 | | | 12.0 | 12.0 |
| 3 | 22.7 | 75.0 | | | | | 25.0 | | | | 0.0 | 0.0 |
| 4 | 20.3 | 61.5 | 30.0 | | 7.0 | | | 1.5 | | | 7.0 | 7.0 |
| 5 | 18.7 | 62.0 | 30.0 | | 8.0 | | | | | | 8.0 | 8.0 |
| 6 | 13.4 | 51.5 | 23.0 | 25.0 | | | | 0.5 | | | 25.0 | 0.0 |
| 7 | 15.1 | 51.5 | 23.0 | 23.0 | 2.0 | | | 0.5 | | | 25.0 | 2.0 |
| 8 | 18.7 | 50.4 | 23.0 | 23.0 | | 3.0 | | 0.6 | | | 26.0 | 3.0 |
| 9 | 15.5 | 70.0 | 18.0 | 11.0 | | | | 1.0 | | | 11.0 | 0.0 |
| 10 | 14.3 | 70.0 | 18.0 | 11.0 | | | | 1.0 | | | 11.0 | 0.0 |
| 11 | 4.9 | 100.0 | 0.0 | | | | 0.0 | | | | 0.0 | 0.0 |
| 12 | 9.7 | 98.0 | 1.0 | | | | 0.0 | 1.0 | | | 0.0 | 0.0 |
| 13 | 12.9 | 93.0 | 0.0 | 5.0 | | | 1.0 | | 1.0 | | 5.0 | 0.0 |
| 14 | 9.7 | 95.0 | 0.0 | | | | 5.0 | | | | 0.0 | 0.0 |
| 15 | 7.2 | 97.0 | 2.0 | | | | 1.0 | | | | 0.0 | 0.0 |
| 16 | 10.2 | 95.0 | | 3.0 | | | 2.0 | | | | 3.0 | 0.0 |
| 17 | 7.7 | 97.0 | 2.0 | | | | 1.0 | | | | 0.0 | 0.0 |
| 18 | 7.4 | 97.0 | 2.0 | | | | 1.0 | | | | 0.0 | 0.0 |
| 19 | 12.0 | 69.0 | 20.0 | 11.0 | | | | | | | 11.0 | 0.0 |
| 20 | 12.5 | 69.0 | 20.0 | 11.0 | | | | | | | 11.0 | 0.0 |
| 21 | 11.8 | 69.0 | 20.0 | 11.0 | | | | | | | 11.0 | 0.0 |
| 22 | 10.5 | 95.0 | 0.0 | | | | 5.0 | | | | 0.0 | 0.0 |
| 23 | 10.0 | 95.0 | 0.0 | | | | 5.0 | | | | 0.0 | 0.0 |
| 24 | 7.2 | 97.0 | 2.0 | | | | 1.0 | | | | 0.0 | 0.0 |

TABLE 1-continued

| | | | | | | | | | | | | |
|---|---|---|---|---|---|---|---|---|---|---|---|---|
| 25 | 9.1 | 70.0 | 30.0 | | | | | | | | 0.0 | 0.0 |
| 26 | 9.1 | 70.0 | 30.0 | | | | | | | | 0.0 | 0.0 |
| 27 | 14.3 | 70.0 | 18.0 | 11.0 | | | | 1.0 | | | 11.0 | 0.0 |
| 28 | 13.3 | 70.2 | 18.0 | 11.0 | | | | 0.8 | | | 11.0 | 0.0 |
| 29 | 18.5 | 69.5 | 21.0 | 5.0 | 3.0 | 0.5 | | | 1.0 | | 8.5 | 3.5 |
| 30 | 18.1 | 69.5 | 21.0 | 5.0 | 3.0 | 0.5 | | | 1.0 | | 8.5 | 3.5 |
| 31 | 17.7 | 69.5 | 21.0 | 5.0 | 3.0 | 0.5 | | | 1.0 | | 8.5 | 3.5 |
| 32 | 15.6 | 69.5 | 18.0 | 11.0 | | | | 1.5 | | | 11.0 | 0.0 |
| 33 | 15.1 | 69.5 | 18.0 | 11.0 | | | | 1.5 | | | 11.0 | 0.0 |
| 34 | 12.8 | 52.5 | 23.0 | 24.0 | | | | 0.5 | | | 24.0 | 0.0 |
| 35 | 13.4 | 52.4 | 23.0 | 24.0 | | | | 0.6 | | | 24.0 | 0.0 |
| 36 | 16.2 | 52.0 | 23.0 | 23.0 | | 1.0 | | 1.0 | | | 24.0 | 1.0 |
| 37 | 13.0 | 72.0 | 20.0 | | | | 7.0 | 1.0 | | | 0.0 | 0.0 |
| 38 | 18.5 | 70.0 | 20.0 | | | | 7.0 | 3.0 | | | 0.0 | 0.0 |
| 39 | 20.0 | 69.5 | 20.0 | | | | 7.0 | 3.5 | | | 0.0 | 0.0 |
| 40 | 19.3 | 62.0 | 30.0 | | 7.0 | | | 1.0 | | | 7.0 | 7.0 |
| 41 | 13.3 | 79.0 | 5.0 | 15.0 | | | | | | 1.0 | 15.0 | 0.0 |
| 42 | 9.3 | 79.6 | 20.0 | | | | | 0.4 | | | 0.0 | 0.0 |
| 43 | 10.5 | 79.4 | 20.0 | | | | | 0.6 | | | 0.0 | 0.0 |
| 44 | 10.0 | 93.4 | 6.0 | | | | | 0.6 | | | 0.0 | 0.0 |
| 45 | 12.2 | 92.0 | 2.0 | | | | 5.0 | 1.0 | | | 0.0 | 0.0 |
| 46 | 12.5 | 61.0 | 18.0 | 20.0 | | | | 1.0 | | | 20.0 | 0.0 |
| 47 | 14.4 | 49.5 | 35.0 | 15.0 | | | | 0.5 | | | 15.0 | 0.0 |
| 48 | 14.9 | 49.4 | 35.0 | 15.0 | | | | 0.6 | | | 15.0 | 0.0 |
| 49 | 14.8 | 80.0 | 8.0 | 11.0 | | | | 1.0 | | | 11.0 | 0.0 |
| 50 | 14.2 | 70.0 | 18.0 | 11.0 | | | | 1.0 | | | 11.0 | 0.0 |
| 51 | 14.2 | 66.0 | 21.0 | 12.0 | | | | 1.0 | | | 12.0 | 0.0 |
| 52 | 14.5 | 66.0 | 21.0 | 12.0 | | | | 1.0 | | | 12.0 | 0.0 |
| 53 | 14.9 | 66.0 | 21.0 | 12.0 | | | | 1.0 | | | 12.0 | 0.0 |
| 54 | 14.2 | 66.0 | 21.0 | 12.0 | | | | 1.0 | | | 12.0 | 0.0 |
| 55 | 14.7 | 66.0 | 21.0 | 12.0 | | | | 1.0 | | | 12.0 | 0.0 |
| 56 | 14.2 | 70.0 | 18.0 | 11.0 | | | | 1.0 | | | 11.0 | 0.0 |
| 57 | 13.8 | 66.0 | 21.0 | 12.0 | | | | 1.0 | | | 12.0 | 0.0 |
| 58 | 14.1 | 66.0 | 21.0 | 12.0 | | | | 1.0 | | | 12.0 | 0.0 |

| | Coating layer | | High Ni layer | High specific resistance layer | Aspect ratio of crystal | Production method of | Evaluation of abnormal- |
|---|---|---|---|---|---|---|---|
| Test no. | Main element | Thickness (μm) | Ratio (Tn/Th) | Thickness (μm) | grains of body section | coating layer (*) | erosion resistance |
| 1 | Ni | 2 | — | 16 | Small | P | X |
| 2 | Ni | 3 | — | 2 | Large | P | X |
| 3 | Ni | 3 | — | 2 | Large | P | X |
| 4 | Ni | 10 | — | 19 | Small | P | X |
| 5 | Ni | 10 | — | 19 | Small | P | X |
| 6 | Ni | 10 | — | 15 | Small | P | X |
| 7 | Ni | 10 | — | 15 | Small | P | X |
| 8 | Ni | 15 | — | 25 | Small | P | X |
| 9 | Ni | 20 | — | 50 | Large | P | X |
| 10 | Ni | 25 | ○ | 12 | Large | C | X |
| 11 | Ni | 15 | — | 17 | Large | P | X |
| 12 | Ni | 15 | — | 17 | Large | P | X |
| 13 | Ni | 3 | — | 2 | Large | P | X |
| 14 | Au | 10 | ○ | 2 | Large | P | X |
| 15 | Ni | 3 | — | 1 | Small | P | X |
| 16 | Ni | 3 | — | 16 | Small | P | ○ |
| 17 | Ni | 7 | — | 20 | Small | P | ○ |
| 18 | Ni | 10 | — | 20 | Large | P | ◎ |
| 19 | Ni | 10 | — | 18 | Large | P | ☆ |
| 20 | Ni | 20 | — | 45 | Large | P | ☆ |
| 21 | Ni | 3 | — | 2 | Large | P | ★ |
| 22 | Ni | 5 | — | 17 | Large | P | ☆ |
| 23 | Ni | 15 | — | 17 | Large | P | ◎ |
| 24 | Ni | 3 | — | 2 | Large | P | ☆ |
| 25 | Ni | 3 | — | 18 | Large | P | ◎ |
| 26 | Ni | 3 | — | 15 | Large | P | ☆ |
| 27 | Ni | 8 | — | 16 | Large | P | ★ |
| 28 | Ni | 3 | — | 2 | Large | P | ☆☆ |
| 29 | Ni | 12 | — | 23 | Large | P | ☆ |
| 30 | Ni | 12 | ○ | 16 | Large | P | ★ |
| 31 | Ni | 12 | ○ | 4 | Large | P | ☆☆ |
| 32 | Ni | 3 | — | 8 | Large | P | ☆☆ |
| 33 | Ni | 3 | ○ | 5 | Large | P | ★☆ |
| 34 | Ni | 6 | — | 21 | Large | P | ☆ |
| 35 | Ni | 10 | — | 25 | Large | P | ★ |
| 36 | Ni | 10 | — | 25 | Small | P | ☆ |
| 37 | Ni | 3 | — | 18 | Small | P | ☆ |
| 38 | Ni | 3 | — | 16 | Small | P | ☆ |

TABLE 1-continued

| | | | | | | | |
|---|---|---|---|---|---|---|---|
| 39 | Ni | 3 | — | 16 | Small | P | ◎ |
| 40 | Ni | 10 | — | 19 | Small | P | ☆ |
| 41 | Ni | 15 | — | 17 | Large | P | ☆ |
| 42 | Ni | 7 | — | 20 | Large | P | ◎ |
| 43 | Ni | 3 | — | 16 | Large | P | ★ |
| 44 | Ni | 3 | — | 16 | Large | P | ☆ |
| 45 | Ni | 5 | — | 18 | Large | P | ★ |
| 46 | Ni | 3 | — | 17 | Large | P | ★ |
| 47 | Ni | 10 | — | 16 | Large | P | ☆ |
| 48 | Ni | 9 | — | 23 | Large | P | ★ |
| 49 | Ni | 10 | — | 16 | Large | P | ★ |
| 50 | Ni | 20 | — | 25 | Large | P | ★ |
| 51 | Ni | 3 | — | 2 | Large | P | ☆☆ |
| 52 | Ni | 10 | — | 7 | Large | P | ☆☆ |
| 53 | Ni | 3 | — | 15 | Large | P | ☆☆ |
| 54 | Ni | 10 | ○ | 20 | Large | P | ☆☆ |
| 55 | Ni | 16 | ○ | 25 | Large | P | ☆☆ |
| 56 | Ni | 23 | ○ | 7 | Large | C | ★☆ |
| 57 | Ni | 10 | ○ | 3 | Large | P | ★☆ |
| 58 | Ni | 3 | ○ | 2 | Large | P | ★☆ |

(*) P: electroplating
C: cladding

As can be seen from Table 1, tips of test nos. 1-15, which are out of the scope of the present invention, had a short abnormal erosion start time and low abnormal-erosion resistance. Compared to the tips of test nos. 1-15, tips of test nos. 16-58, which are within the scope of the present invention, had a long abnormal erosion start time and good abnormal-erosion resistance. The test results shown in Table 1 will now be described in greater detail.

Test nos. 11-13 are compared with test nos. 16 and 17. Compared to the tips of test nos. 11-13, in which the Rh and Pt contents of the body portion are less than 2 mass %, the tips of test nos. 16 and 17, in which the Rh and Pt contents are 2 mass % and 3 mass %, respectively, had a long abnormal erosion start time and good abnormal-erosion resistance.

Test nos. 6-8 are compared with test nos. 34-36. Compared to the tips of test nos. 6-8, in which the total content of the group-A elements of the body portion exceeds 24 mass %, the tips of test nos. 34-36, in which the total content of the group-A elements is 24 mass %, had a long abnormal erosion start time and good abnormal-erosion resistance. Test no. 5 is compared with test no. 40. Compared to the tip of test no. 5, in which the total content of the group-A elements excluding Ru of the body portion is 7 mass % or greater, the tip of test no. 40, in which the total content of the group-A elements excluding Ru is 7 mass %, had a long abnormal erosion start time and good abnormal-erosion resistance.

Test nos. 9 and 15 are compared with test nos. 17, 20, and 24. Compared to the tip of test no. 9, in which the thickness of the high specific resistance layer exceeds 45 μm, and the tip of test no. 15, in which the thickness of the high specific resistance layer is less than 2 μm, the tips of test nos. 17, 20, and 24, in which the thicknesses of the high specific resistance layer are 20 μm, 45 μm, and 2 μm, respectively, had a long abnormal erosion start time and good abnormal-erosion resistance.

Test nos. 1 and 10 are compared with test nos. 16 and 50. Compared to the tip of test no. 1, in which the thickness of the coating layer is less than 3 μm, and the tip of test no. 10, in which the thickness of the coating layer exceeds 20 μm, the tips of test nos. 16 and 50, in which the thicknesses of the coating layer are 3 μm and 20 μm, respectively, had a long abnormal erosion start time and good abnormal-erosion resistance.

Test nos. 2-4 are compared with test nos. 39 and 40. Compared to the tips of test nos. 2-4, which have a specific resistance exceeding $20\times10^{-8}$ Ωm at room temperature, the tips of test nos. 39 and 40, which have a specific resistance of $20\times10^{-8}$ Ωm and $19.3\times10^{-8}$ Ωm, respectively, at room temperature, had a long abnormal erosion start time and good abnormal-erosion resistance.

Test nos. 18 and 19, test nos. 22 and 23, and test nos. 43 and 44 are compared with each other. Compared to the tips of test nos. 18, 23, and 44, which have a specific resistance of less than $10.5\times10^{-8}$ Ωm at room temperature, the tips of test nos. 19, 22, and 43, which have a specific resistance of $10.5\times10^{-8}$ Ωm or greater at room temperature, had a long abnormal erosion start time and good abnormal-erosion resistance.

Test nos. 15, 19, 20, and 21, test nos. 18 and 24, test nos. 25 and 26, test nos. 27 and 28, and test nos. 54 and 55, and 57 and 58 are compared with each other. Compared to the tips of test nos. 15, 18-20, 25, 27, 54, and 55, in which the thickness of the high specific resistance layer is less than 2 μm, or greater than 15 μm, the tips of test nos. 21, 24, 26, 28, 57, and 58, in which the thickness of the high specific resistance layer is 2 μm or greater and 15 μm or less, had a long abnormal erosion start time and good abnormal-erosion resistance.

Test nos. 29, and 30 and 31, test nos. 32 and 33, and test nos. 51-53 and 56-58 are compared with each other. Compared to the tips of test nos. 29, 32, and 51-53, in which the ratio (Tn/Th) of the thickness Tn of the Ni-rich layer to the thickness Th of the coating layer is less than 0.5, the tips of test nos. 30, 31, 33, and 56-58, in which the ratio (Tn/Th) is 0.5 or greater, had a long abnormal erosion start time and good abnormal-erosion resistance.

Test nos. 34 and 35, test nos. 38 and 39, test nos. 42-44, and test nos. 47 and 48 are compared with each other. Compared to the tips of test nos. 34, 39, 42, and 47, in which the Ni content of the body portion is less than 0.6 mass %, or greater than 3 mass %, the tips of test nos. 35, 38, 43, 44, and 48, in which the Ni content is 0.6 mass % or greater and 3 mass % or less, had a long abnormal erosion start time and good abnormal-erosion resistance.

Test nos. 17 and 18 are compared with each other. Compared to the tip of test no. 17, in which the aspect ratio of crystal grains of the body portion is less than two, the tip of test no. 18, in which the aspect ratio is 2 or greater, had a long abnormal erosion start time and good abnormal-erosion resistance.

2. Evaluation Test II on Abnormal-Erosion Resistance

Production of Spark Plug Test Body

The same spark plug test bodies as those of test nos. 1-58 were produced, except that the thickness of the coating layer was 3 μm, the coating layer did not include a Ni-rich layer containing 70 mass % or more of Ni, and the thickness of the high specific resistance layer was within the range of 2-5 μm.

The compositions of the tips, the thicknesses of the coating layer, etc., and the specific resistance were measured in a manner similar to that in the abnormal-erosion resistance evaluation test I.

Method for Evaluation Test on Abnormal-Erosion Resistance

Each produced spark plug test body was attached to an engine for testing. The engine was run at full throttle and at a rotational speed of 5,000 rpm. The temperature at a position which is 0.5 mm away from a front end portion of the center electrode, as measured using a thermocouple, was adjusted to 1,000° C. In a similar manner to that in the endurance test A, the cycle of full throttle and engine stoppage was repeatedly performed. This test is referred to as "endurance test B". An endurance test C was performed in the same manner as that in the endurance test B, except that the temperature at a position which is 0.5 mm away from a front end portion of the center electrode, as measured using a thermocouple, was adjusted to 1,030° C.

As in the endurance test A, in the endurance test B and the endurance test C, abnormal erosion start times Y and Z were measured, respectively, and abnormal-erosion resistance was evaluated using the following references. The results are shown in Table 2.

-: Y-Z>20 h

Open circle: Y-Z≤20 h

As can be seen from Table 2, test nos. 60, 64, and 66, and test nos. 78 and 75 are compared with each other. Compared to the tips of test nos. 60, 64, and 78, in which the Rh content of the body portion is less than 6 mass %, or greater than 32 mass %, when the tips of test nos. 66 and 75, in which the Rh contents are 6 mass % and 32 mass %, respectively, were used in a higher temperature environment, the abnormal erosion start time of abnormal erosion was not relatively shortened, and the decrease in abnormal-erosion resistance was small.

Test nos. 59 and 82 are compared with test no. 74. Compared to the tips of test nos. 59 and 82, in which the Ru content of the body portion is less than 4 mass %, when the tip of test no. 74, in which the Ru content is 4 mass %, was used in a higher temperature environment, the abnormal erosion start time of abnormal erosion was not relatively shortened, and the decrease in abnormal-erosion resistance was small.

The tips of test nos. 60-63 are compared with the tip of test no. 65. Compared to the tips of test nos. 60-63, in which the total content of Ir, Ru, Re, and W of the body portion is greater than 93 mass %, when the tip of test no. 65, in which the total content of Ir, Ru, Re, and W is 93 mass %, was used in a higher temperature environment, the abnormal erosion start time of abnormal erosion was not relatively shortened, and the decrease in abnormal-erosion resistance was small.

Test nos. 77 and 79-81 are compared with test nos. 69-72. Compared to the tips of test nos. 77 and 79-81, in which the Ir content of the body portion is less than 60 mass %, when the tips of test nos. 69-72, in which the Ir content is 60 mass % or greater, was used in a higher temperature environment, the abnormal erosion start time of abnormal erosion was not relatively shortened, and the decrease in abnormal-erosion resistance was small.

DESCRIPTION OF REFERENCE NUMERALS

1, 101: spark plug

2: axial hole

TABLE 2

| Test no. | Specific resistance ($10^{-8}$ Ωm) | Composition of body section (mass %) | | | | | | | | | | Total content of group-A elements | Total content of group-A elements excluding Ru | Ir + Ru + Re + W | Elements excluding Ir | Evaluation of abnormal-erosion resistance |
|---|---|---|---|---|---|---|---|---|---|---|---|---|---|---|---|---|
| | | Ir | Rh | Ru | Re | W | Mo | Pt | Ni | Co | Pd | | | | | |
| 59 | 9.1 | 70 | 30 | | | | | | | | | 0 | 0 | 70.0 | 30.0 | — |
| 60 | 11.3 | 93.0 | | 5.0 | | | | 2.0 | | | | 5 | 0 | 98.0 | 7.0 | — |
| 61 | 10.7 | 90 | 5 | 5 | | | | | | | | 5 | 0 | 95.0 | 10.0 | — |
| 62 | 12.8 | 89 | 5 | 5 | | | | | | 1 | | 5 | 0 | 94.0 | 11.0 | — |
| 63 | 10.5 | 90 | 6 | 4 | | | | | | | | 4 | 0 | 94.0 | 10.0 | — |
| 64 | 16.3 | 81 | 5 | 12 | | | | | 1.0 | 1.0 | | 12 | 0 | 93.0 | 19.0 | — |
| 65 | 11.9 | 89 | 6 | 4 | | | | 1.0 | | | | 4 | 0 | 93.0 | 11.0 | ○ |
| 66 | 12.5 | 81 | 6 | 12 | | | | | | | 1 | 12 | 0 | 93.0 | 19.0 | ○ |
| 67 | 12.8 | 69 | 6 | 24 | | | | 0.5 | 0.5 | | | 24 | 0 | 93.0 | 31.0 | ○ |
| 68 | 18.1 | 62 | 30 | 4 | | 2 | 1 | | 1.0 | | | 7 | 3 | 68.0 | 38.0 | ○ |
| 69 | 19.3 | 60 | 32 | 4 | 1 | 2 | | | 1.0 | | | 7 | 3 | 67.0 | 40.0 | ○ |
| 70 | 11.1 | 60 | 16 | 24 | | | | | | | | 24 | 0 | 84.0 | 40.0 | ○ |
| 71 | 12.1 | 60 | 24 | 16 | | | | | | | | 16 | 0 | 76.0 | 40.0 | ○ |
| 72 | 13.4 | 60 | 28 | 12 | | | | | | | | 12 | 0 | 72.0 | 40.0 | ○ |
| 73 | 14.2 | 66 | 21 | 12 | | | | | 1.0 | | | 12 | 0 | 78.0 | 34.0 | ○ |
| 74 | 10.8 | 72 | 24 | 4 | | | | | | | | 4 | 0 | 76.0 | 28.0 | ○ |
| 75 | 12.4 | 63.4 | 32 | 4 | | | | | 0.6 | | | 4 | 0 | 67.4 | 36.6 | ○ |
| 76 | 13.2 | 60 | 32 | 8 | | | | | | | | 8 | 0 | 68.0 | 40.0 | ○ |
| 77 | 13.5 | 59 | 16 | 24 | | | | | 1.0 | | | 24 | 0 | 83.0 | 41.0 | — |
| 78 | 11.8 | 63 | 33 | 4 | | | | | | | | 4 | 0 | 67.0 | 37.0 | — |
| 79 | 14 | 59 | 21 | 18 | | | | 1.0 | 1.0 | | | 18 | 0 | 77.0 | 41.0 | — |
| 80 | 12.1 | 59 | 29 | 12 | | | | | | | | 12 | 0 | 71.0 | 41.0 | — |
| 81 | 13.9 | 48 | 31 | 20 | | | | | 1.0 | | | 20 | 0 | 68.0 | 52.0 | — |
| 82 | 12.2 | 72.1 | 24 | 3 | | | | | 0.9 | | | 3 | 0 | 75.1 | 27.9 | — |

3: insulator
4, 104: center electrode
5: metal terminal
6: connection part
7: metal shell
8, 108, 208: ground electrode
9, 109, 209, 309: tip
11: rear trunk portion
12: large diameter portion
13: front trunk portion
14: leg portion
15: shelf portion
16: flange portion
17: step portion
18: tapered portion
19: plate packing
21: resistor
22: first seal body
23: second seal body
24: screw portion
25: gas seal portion
26: tool engagement portion
27: crimping portion
28, 29: packing
30: talc
32: projection
34: rear end portion
35: rod-like portion
41: body portion
42: high specific resistance layer
43: coating portion
44: fusion portion
45: Ni-rich layer
G, G': spark discharge gap Having described the invention, the following is claimed:

1. A spark plug comprising:

a center electrode;

a ground electrode with a gap being interposed between the center electrode and the ground electrode; and a tip provided on at least one of front end portions, facing each other, of the center electrode and the ground electrode, the tip extending along an axial line, wherein the tip includes a body portion, a coating layer, and a high specific resistance layer, wherein the body portion contains Ir as a main component, wherein a total content of Rh and Pt in the body portion is in a range of 2 mass % and 35 mass %, wherein a total content of group-A elements in the body portion is less than or equal to 24 mass %, wherein a total content of the group-A elements excluding Ru is less than or equal to 7 mass %, wherein the group-A elements are metal elements having a crystal structure different from a crystal structure of Ir, Rh, and Pt at room temperature, wherein the high specific resistance layer is provided on a side peripheral surface of the body portion, wherein a content of Ni in the high specific resistance layer is greater than a content of Ni in the body portion and less than 50 mass % of the high specific resistance layer, wherein the high specific resistance layer has a thickness of the high specific resistance layer is in a range of 2 μm and 45 μm, wherein the coating layer is provided on a side peripheral surface of the high specific resistance layer, wherein a content of Ni in the coating layer is greater than or equal to 50 mass %, wherein a thickness of the coating layer is in a range of 3 μm and 20 μm, and wherein a specific resistance of the tip at room temperature is less than or equal to $20\times10^{-8}$ Ωm.

2. The spark plug according to claim 1, wherein the specific resistance of the tip at room temperature is in a range of $10.5\times10^{-8}$ Ωm and $20\times10^{-8}$ Ωm.

3. The spark plug according to claim 1, wherein the thickness of the high specific resistance layer is in a range of 2 μm and 15 μm.

4. The spark plug according to claim 1, wherein an Ni-rich layer of the coating layer has a content of Ni that is greater than or equal to 70 mass %, and wherein a ratio (Tn/Th) of a thickness Tn of the Ni-rich layer to a thickness Th of the coating layer is greater than or equal to 0.5.

5. The spark plug according to claim 1, wherein the content of Ni in the body portion is in a range of 0.6 mass % and 3 mass %.

6. The spark plug according to claim 1, wherein the body portion is an aggregation of crystal grains having a shape extending along the axial line, and the crystal grains have an aspect ratio of 2 or greater.

7. The spark plug according to claim 1, wherein the body portion contains at least Ir, Rh, Ru from a group of elements consisting of Ir, Rh, Ru, Re, and W, wherein a content of Ir in the body portion is in a range of 60 mass % and 89 mass %, wherein the content of Rh in the body portion is in a range of 6 mass % and 32 mass % wherein a content of Ru in the body portion is in a range of 4 mass % and 24 mass %, wherein a total content of Ir, Ru, Re, and W in the body portion is in a range of 67 mass % and 93 mass %, and wherein a total content of Ir and Rh in the body portion is in a range of 75 mass % and 96 mass %.

* * * * *